US006577074B1

(12) United States Patent
Ervin et al.

(10) Patent No.: US 6,577,074 B1
(45) Date of Patent: Jun. 10, 2003

(54) LIGHTING SYSTEM

(75) Inventors: Robert M. Ervin, Gaithersburg, MD (US); George Jarrard, Westminster, MD (US); Pedro Lezcano, Gaithersburg, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 10/028,773

(22) Filed: Dec. 28, 2001

(51) Int. Cl.[7] ..... H05B 41/16
(52) U.S. Cl. ..... 315/248; 315/39
(58) Field of Search ..... 315/246, 248, 315/39, 344, 267

(56) References Cited

U.S. PATENT DOCUMENTS 4,121,079 A * 10/1978 Harmon ..... 219/718
4,866,351 A * 9/1989 Yazaki ..... 315/248
5,847,517 A * 12/1998 Ury et al. ..... 315/248
5,977,712 A * 11/1999 Simpson ..... 315/39
6,031,333 A * 2/2000 Simpson ..... 315/39
6,046,545 A * 4/2000 Horiuchi et al. ..... 315/39

* cited by examiner

*Primary Examiner*—Don Wong
*Assistant Examiner*—Ephrem Alemu
(74) *Attorney, Agent, or Firm*—Antonelli, Terry, Stout & Kraus, LLP

(57) ABSTRACT

The invention is a lighting system which produces visible and UV light. The system includes a light bulb (60) which emits light in response to excitation by radio frequency energy; an electrically powered bulb rotation motor (50) mechanically coupled to the light bulb which rotates the light bulb coupled thereto; an electrically energized radio frequency energy source (70) which provides the radio frequency energy coupled to the light bulb, the electrically energized radio frequency energy source including a heater (110) which is energized at least while the radio frequency energy source is turned on; and a control circuit (24), for coupling to an electrical power source, which controls application of a regulated voltage to the heater and the bulb rotation motor.

25 Claims, 2 Drawing Sheets

LIGHTING SYSTEM

BACKGROUND OF THE INVENTION

1. Field of the Invention

The invention relates to electrodeless lighting systems and more particularly, to electrodeless lighting system utilizing rotating bulbs.

2. Description of the Prior Art

The use of electrodeless bulbs which are excited by radio frequency (RF) sources for curing applications is well known. In many electrodeless bulb curing systems, a motor is utilized to rotate the bulb during excitation by the RF energy for various well-known advantages.

FIG. 1 illustrates a prior art system of the type in which the Assignee's ultraviolet (UV) electrodeless bulbs are utilized. The system 10 includes an irradiator 12 which is comprised of a bulb 60 and a magnetron 70 from which microwaves are coupled through waveguide 80. The irradiator outputs UV light 14 inside of a customer supplied light shield 16 through which customer product flows on a conveyor system 18 as indicated by the directional arrow. The curved arrows indicate cooling air flow from blower 20. The RF detector 26 detects when unacceptably high RF leakage is present and when unacceptable high leakage is detected, the system is shut down by the RF detector. The magnetron 70 contained within the irradiator 12 may be air cooled as illustrated by a source of air from blower 20, which is blown into the irradiator through line 22. The air from the blower 20 serves to cool both the rotating bulb 60 and the magnetron 70. Alternatively, the magnetron 70 may be water cooled. The magnetron 70 contains an electrical filament heater which, when energized with an AC potential, such as 3.4 or 4.1 volts, produces a source of electrons which, upon the application of high voltage, such as 4 KV, causes electrical oscillation to produce high frequency RF energy, such as, for example, of 2450 MHz. which is coupled to rotating bulb 60 which is rotated by motor 50.

A power supply 32 provides electrical power to the blower 20 and to the control circuit 24. The power supply also produces the aforementioned high voltage for the magnetron. The control circuit 24 functions to produce a regulated output for powering a filament heater transformer (not illustrated). The filament transformer steps down the voltage to a lower potential that is appropriate for the magnetron filament heater. The control circuit 24 may apply at least two electrical potentials or a continuously variable voltage to the filament heater. The variation of the voltage applied by the control circuit 24 to the filament heater of the magnetron 60 is chosen dependent upon the power level of the RF energy being outputted by the magnetron 70 and further, whether or not the magnetron is being operated. The applied potential to the filament heater typically is higher when it is preheated when the magnetron is not operating than when the magnetron is operating. A typical voltage applied to the filament heater during non-operation of the magnetron is 4.1 volts and a typical voltage applied to the filament heater during operation is 3.4 volts. The filament heater voltage is produced by the aforementioned step down transformer which is powered from single phase alternating current provided by single phase power source 34 which is represented by electrical power produced by the electrical power mains. Additionally, a customer interface 36 provides on/off control for the power supply 32 and therefore, the operation of the overall lighting system.

As illustrated, the motor 50 within the irradiator 12 which rotates the electrodeless bulb 60 therein, is powered by a separate power source and cable (not illustrated). The separate power source does not have voltage regulation. The electrical cable 40 between the control circuit 24 and the irradiator 12 has a standard number of conductors to enable it to be used with different model numbers of the Assignee's UV light products. It is further desirable to reduce the number of electrical wires in the electrical cable 40 to as small of a number as possible. The cable 40 does not contain an electrical conductor for providing for electrical power therein for driving the bulb rotation motor 50.

Applications for UV lighting systems, as described in FIG. 1, are required to accept input voltages from the single phase power source 34 varying between 180 volts and 264 volts with frequencies of both 50 and 60 Hz. The overall design of powering a magnetron 70 and bulb rotation motor 50 in these applications can be expensive and difficult with it being necessary for the control circuit 24 to provide the aforementioned characteristics.

The life of the bulb rotation motor 50 is dependent upon operation within a narrow voltage range and further being energized for as little time as possible with the minimum time being during only operation of the electrodeless bulb 60.

SUMMARY OF THE INVENTION

The present invention solves the problems of the prior art of FIG. 1 by electrically powering the bulb rotation motor for rotating an electrodeless bulb and the heater for the RF source for exciting the electrodeless bulb, such as in a magnetron, in parallel under the control of a control circuit. With the invention, the single phase power is applied to the control circuit which provides regulated output voltage to the heater and the bulb rotation motor. The application of regulated voltage to the filament heater and the motor insures that proper electrical potential is applied to the heater to insure controlled operation of the RF energy source in accordance with the prior art and further, a controlled voltage to the bulb rotation motor which insures long life thereof and further permits a limited number of electrical conductors to be used to connect the control circuit to the irradiator which contains the electrodeless bulb and the motor for rotating the bulb.

In accordance with one embodiment of the invention, the motor for rotating the bulb, a transformer for stepping down the voltage applied to the heater, the control circuit for controlling the application of voltage to the heater and motor, and the RF energy source in the form of a magnetron are selected to be compatible. For example, without limitation, a 5 watt, 120 Volt AC synchronous motor may be chosen to provide a fixed rotational velocity for the electrodeless bulb dependent upon the frequency of the electrical power. The motor draws minimal current, both from an operating and starting standpoint, which does not disrupt the operation of the control circuit. The motor is designed to operate at a constant rotational velocity over a wide range of voltage inputted from the electrical power supply.

The step-down transformer reduces the voltage applied to the heater and may have a primary winding with an input voltage in a voltage range which is within the operating range for the AC motor. The secondary of the step-down transformer may be designed to provide 3.4 volts for heating a magnetron filament such as a 1,000 watt magnetron. During standby operation, the filament heater may be designed to operate at a slightly higher potential, such as 4.1 volts as a result of there being no heat generated by operation of the magnetron. The control circuit adjusts the phase angle firing point of a triac to control the AC voltage to the transformer primary and the motor to a fixed potential such as 120 volts.

The control circuit senses the input voltage and adjusts the phase angle firing point of the triac to maintain the AC voltage to the motor and transformer substantially constant depending on the electrodeless bulb operating mode. For example, a substantially constant output is produced by the control circuit, may be plus or minus 1% of a nominal rated output voltage even though the input voltage from the power mains is possible to vary with a substantially higher voltage range greater than plus or minus 1%.

Additionally, a photosensitive switch may be connected in series with the bulb rotating motor which disconnects the electrical power produced by the control circuit from being applied to the bulb rotating motor so as to stop the motor from rotating when the magnetron is turned off.

The present invention provides substantial advantages over the prior art. The transformer used for stepping down the voltage to the heater is located within the irradiator containing the RF energy source and the electrodeless bulb. The transformer is desirably positioned in the irradiator a fixed distance from and close to the RF source so that the voltage drop between the transformer for powering the heater in the RF source and the RF source is controlled which is very significant in controlling the life of the RF source which is typically a magnetron. Variation in the length of the cable connecting the control circuit to the irradiator can alter the heater heating voltage which can lead to premature failure of the RF source.

Additionally, the cost, weight and other penalties associated with providing an additional cable for powering the bulb rotation motor of the prior art are eliminated. Furthermore, the heater control circuit applies a substantially constant voltage to the motor even though the input voltage varies dependent upon different standards utilized in different countries in which the present invention may be used. This permits a single bulb rotation motor, transformer, magnetron and control circuit to be used in light sources utilizing the present invention throughout the world.

Furthermore, while a preferred application of the present invention is in applications requiring the generation of UV for curing of surface coatings, the present invention may be utilized in other applications such as the generation of visible light.

A lighting system in accordance with the invention includes a light bulb which emits light in response to excitation by radio frequency energy; an electrically powered bulb rotation motor mechanically coupled to the light bulb which rotates the light bulb coupled thereto; an electrically energized radio frequency energy source which provides the radio frequency energy coupled to the light bulb, the electrically energized radio frequency energy source including a heater which is energized at least while the radio frequency energy source is turned on; and a control circuit, for coupling to an electrical power source, which controls application of a regulated voltage to the heater and the bulb rotation motor. The regulated voltage may be substantially constant and vary sinusoidally. A light responsive element may be coupled to the motor which removes application of electrical power by the control circuit to the electrically powered motor when light from the light bulb is not sensed by the light responsive element. The light may be visible or UV light. The electrically energized radio frequency energy source may be a magnetron and the heater may be a filament. The control circuit may deliver the regulated output voltage which is substantially constant in response to voltages which vary in magnitude when provided to the control circuit from an electrical power source.

BRIEF DESCRIPTION OF THE DRAWINGS

Like reference numerals identify like parts throughout the drawings.

DESCRIPTION OF THE PREFERRED EMBODIMENT

Figure 1:
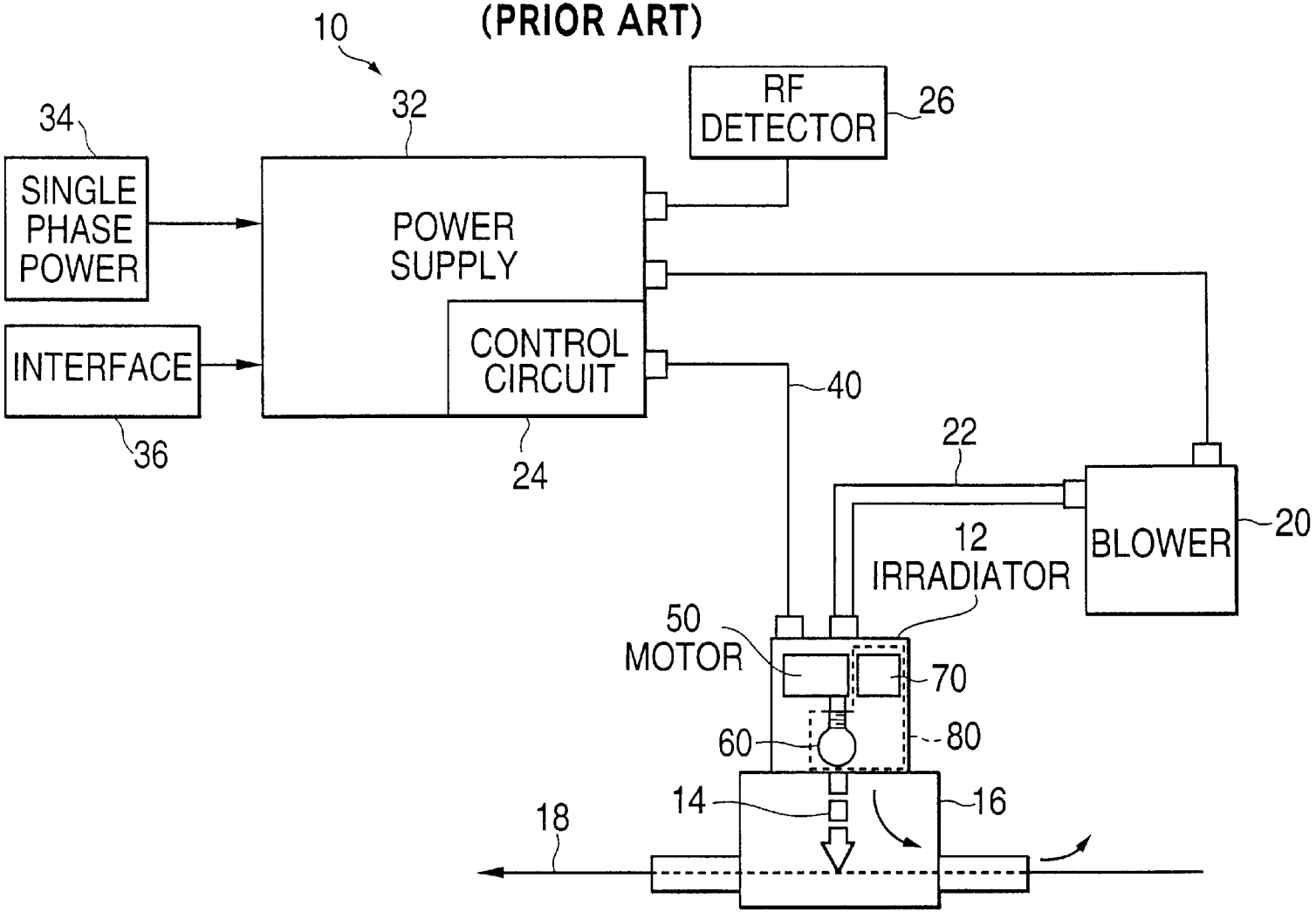
FIG. 1 (PRIOR ART)
FIG. 1 illustrates a prior art diagram of a UV curing system of the type in which the Assignee's UV lighting products are used.
Figure 2:
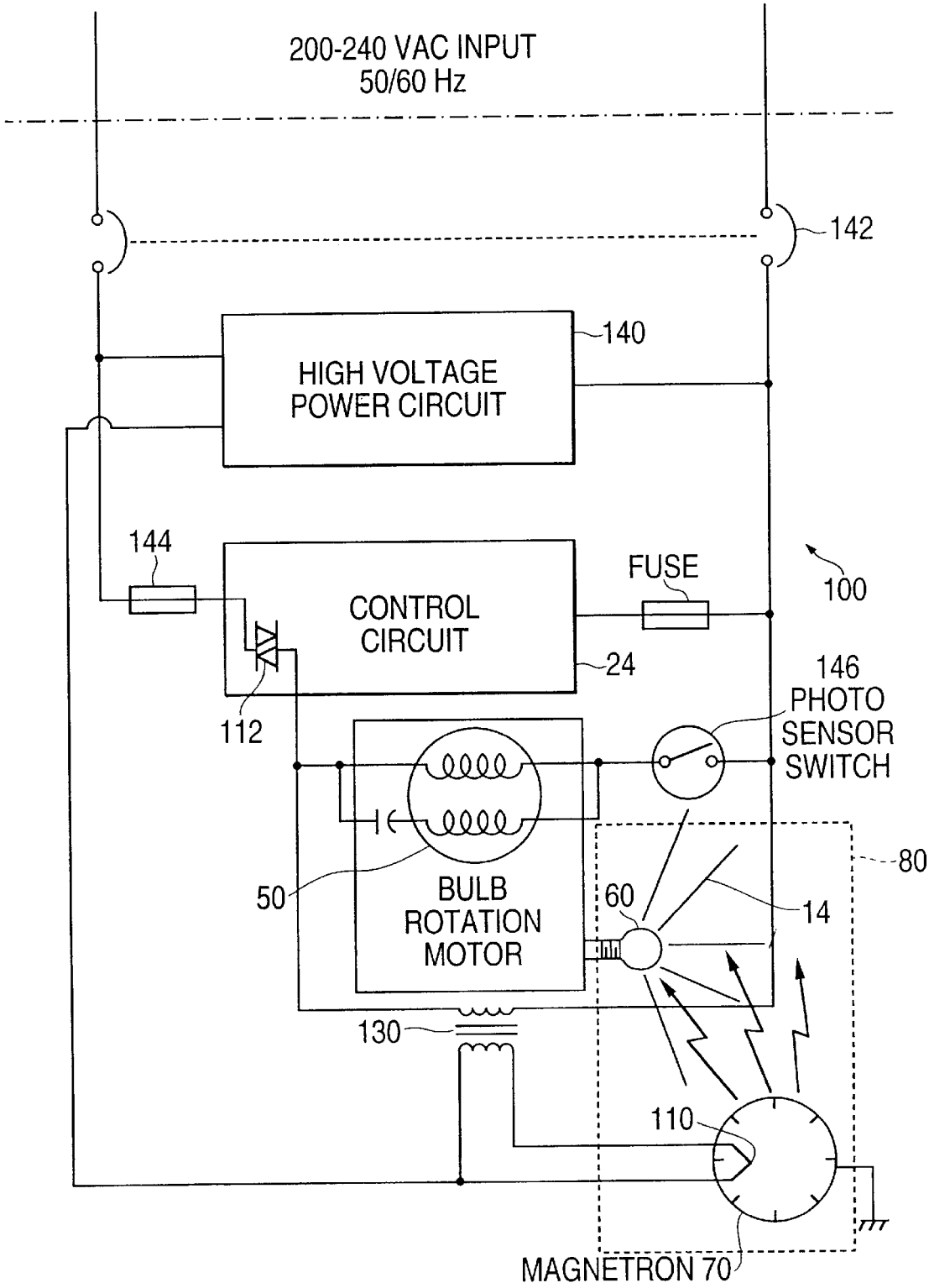
FIG. 2 illustrates a block diagram of an embodiment of the present invention.

FIG. 2 illustrates a block diagram of an embodiment of the present invention. The embodiment 100 differs from the prior art in that the control circuit 24 powers the heater 110 in RF source 70 which may be a magnetron and the bulb rotation motor 50 in parallel. This permits the same number of electrical conductors in the cable 40 which were utilized in the prior art to power the irradiator 12 to additionally control the application of electrical power to the bulb rotation motor 50. As is understood, the RF energy source 70 couples RF power to the electrodeless bulb 60 which is only shown as symbolically outputting UV light 14 to a target, such as a conveyor 18 as illustrated in FIG. 1, to cure surface coatings on products therein. However, it should be understood that the present invention is not limited to UV curing applications and, in fact, may produce light for illumination purposes. The control circuit 24 contains a triac 112 or other device for producing substantially constant AC which varies, for example, by plus or minus 1%. The substantially constant AC produced by the control circuit 24 has a potential which is controlled by the firing point of the triac 112 which is within the operational voltage range of the motor 50, such as, without limitation, 120 volts. Step-down transformer 130 steps down the AC voltage produced by the control circuit 24 from the potential used for powering the motor 50 to a lower potential, such as between 3 and 4 volts discussed above which is applied to the heater 110. The control circuit 24 may cause application of voltage in at least two or more steps to control the operation of the heater 110 to control and regulate the filament temperature and operation thereof to produce the required source of electrons to sustain operation of the magnetron for differing power levels while at the same time enhancing the overall life of the magnetron. Additionally, a high voltage power circuit 140 is powered by the single phase AC inputted from the single phase power source 34 and produces a high voltage potential, such as 4,000 volts, which is required to sustain operation of the RF energy source 70 in the form of a magnetron. The high voltage power circuit 140 is of conventional design. The circuit breaker 142 may be utilized for controlling the on/off state of the lighting system. Additionally, a fuse or other circuit breaker 144 may be provided to protect the heater control circuit 24.

Photosensor switch 146 is connected in series with the bulb rotation motor 50 which open circuits the bulb rotation motor when light 14 from the light bulb 60 is not being generated. The use of the photosensor switch 146 ensures that the bulb rotation motor 50 will only be energized during actual operations which lengthens the life of the bulb rotation motor 50.

While a preferred embodiment of the invention utilizes a synchronous motor 50 to rotate the bulb 60, it should be understood that DC motors may also be used. In this event, additional well-known circuitry will be used to convert from AC to DC for powering the motor 50.

While the invention has been described in terms of its preferred embodiments, it should be understood that numerous modifications may be made thereto without departing from the spirit and scope of the present invention. It is intended that all such modifications fall within the scope of the appended claims.

What is claimed is:

1. A lighting system comprising:

a light bulb which emits light response to excitation by radio frequency energy;

an electrically powered bulb rotation motor mechanically coupled to the light bulb which rotates the light bulb coupled thereto;

an electrically energized radio frequency energy source which provides the radio frequency energy coupled to the light bulb, the electrically energized radio frequency energy source including a heater which is energized at least while the radio frequency energy source is turned on; and a control circuit, for coupling to an electrical power source, which controls application of a regulated voltage to the heater and the bulb rotation motor.

2. A system in accordance with claim 1 wherein:

the regulated voltage is substantially constant and varies sinusoidally.

3. A system in accordance with claim 1 comprising:

a light responsive element, coupled to the motor, which removes application of electrical power by the control circuit to the electrically powered motor when light from the light bulb is not sensed by the light responsive element.

4. A system in accordance with claim 2 comprising:

a light responsive element, coupled to the motor, which removes application of electrical power by the control circuit to the electrically powered motor when light from the light bulb is not sensed by the light responsive element.

5. A lighting system in accordance with claim 1 wherein:

the light is visible light.

6. A lighting system in accordance with claim 2 wherein:

the light is visible light.

7. A lighting system in accordance with claim 3 wherein:

the light is visible light.

8. A lighting system in accordance with claim 4 wherein:

the light is visible light.

9. A lighting system in accordance with claim 1 wherein:

the light is ultraviolet light.

10. A lighting system in accordance with claim 2 wherein:

the light is ultraviolet light.

11. A lighting system in accordance with claim 3 wherein:

the light is ultraviolet light.

12. A lighting system in accordance with claim 4 wherein:

the light is ultraviolet light.

13. A lighting system in accordance with claim 1 wherein:

the electrically energized radio frequency energy source is a magnetron and the heater is a filament.

14. A lighting system in accordance with claim 2 wherein:

the electrically energized radio frequency energy source is a magnetron and the heater is a filament.

15. A lighting system in accordance with claim 3 wherein:

the electrically energized radio frequency energy source is a magnetron and the heater is a filament.

16. A lighting system in accordance with claim 4 wherein:

the electrically energized radio frequency energy source is a magnetron and the heater is a filament.

17. A lighting system in accordance with claim 5 wherein:

the electrically energized radio frequency energy source is a magnetron and the heater is a filament.

18. A lighting system in accordance with claim 6 wherein:

the electrically energized radio frequency energy source is a magnetron and the heater is a filament.

19. A lighting system in accordance with claim 7 wherein:

the electrically energized radio frequency energy source is a magnetron and the heater is a filament.

20. A lighting system in accordance with claim 8 wherein:

the electrically energized radio frequency energy source is a magnetron and the heater is a filament.

21. A lighting system in accordance with claim 9 wherein:

the electrically energized radio frequency energy source is a magnetron and the heater is a filament.

22. A lighting system in accordance with claim 10 wherein:

the electrically energized radio frequency energy source is a magnetron and the heater is a filament.

23. A lighting system in accordance with claim 11 wherein:

the electrically energized radio frequency energy source is a magnetron and the heater is a filament.

24. A lighting system in accordance with claim 12 wherein:

the electrically energized radio frequency energy source is a magnetron and the heater is a filament.

25. A lighting system in accordance with claim 2 wherein:

the control circuit delivers the regulated output voltage which is substantially constant in response to voltages which vary in magnitude when provided to the control circuit from an electrical power source.

* * * * *